US005368379A

United States Patent [19]

Wrangberth

[11] Patent Number: 5,368,379

[45] Date of Patent: Nov. 29, 1994

[54] DISHWASHER CHASSIS

[75] Inventor: Jan S. Wrangberth, Huskvarna, Sweden

[73] Assignee: Aktiebolaget Electrolux, Sweden

[21] Appl. No.: 835,054

[22] Filed: Feb. 11, 1992

Related U.S. Application Data

[63] Continuation of Ser. No. 666,629, Mar. 8, 1991, abandoned.

[30] Foreign Application Priority Data

Apr. 12, 1990 [SE] Sweden ..... 9001336

[51] Int. Cl.[5] ..... A47B 77/06

[52] U.S. Cl. ..... 312/228; 134/200

[58] Field of Search ..... 312/7.2, 228, 7.1; 68/3 R; 134/200, 201, 135; 220/408, 410

[56] References Cited

U.S. PATENT DOCUMENTS

| | | | |
|---|---|---|---|
| 2,206,225 | 7/1940 | Goodheart | 312/7.1 |
| 3,541,256 | 11/1970 | Anders | 312/7.2 X |
| 3,811,746 | 5/1974 | Butsch et al. . | |
| 4,098,545 | 7/1978 | Gaiser | 134/201 X |
| 4,133,507 | 1/1979 | Chervenak | 312/245 X |
| 4,295,692 | 10/1981 | Jenkins . | |
| 4,359,250 | 11/1982 | Jenkins | 312/229 X |
| 4,811,997 | 3/1989 | Suyama et al. . | |
| 4,940,298 | 7/1990 | Jackson et al. | 312/228 |

FOREIGN PATENT DOCUMENTS

| | | |
|---|---|---|
| 2311523 | 12/1976 | France . |
| 2471175 | 6/1981 | France . |

*Primary Examiner*—Brian K. Green

*Attorney, Agent, or Firm*—Pearne, Gordon, McCoy & Granger

[57] ABSTRACT

A dishwasher chassis includes a tub into which dishes are inserted. The tub is placed on a torsion stiff shell structure (10, 22), with a part of the shell comprising the bottom of the tub.

20 Claims, 1 Drawing Sheet

DISHWASHER CHASSIS

This is a continuation of application Ser. No. 07/666,629, filed Mar. 8, 1991, now abandoned.

BACKGROUND OF THE INVENTION

This invention relates to dishwashers and, in particular, to the design of the chassis of such a machine.

Dishwashers are usually manufactured by mounting a tub, comprising a bottom, three walls, and a roof formed of sheet metal, on a base which is manufactured by joining several beams and/or metal plates by bending, welding, or screwing operations to form a support on which an outer shell, if any, and related components are fastened. The method is troublesome and time-consuming, and has the draw-back that it is very difficult to achieve a construction which has sufficient stiffness because of the cumulative mechanical play provided by the large number of joints connecting the different parts. Thus, handling during transportation between manufacturer and customer often causes distortion and misalignment between the parts of the machine.

It is also previously known from DE 2,420,302 to design the dishwasher so that the upper part of the tub, which is produced from sheet metal, is placed on a foamed plastic base, with a labyrinth seal placed between the parts. According to this arrangement, the pumps and other components are installed on the base, thus providing for easy assembly. The patent publication, however, does not describe a method for increasing the rigidity of the dishwasher.

In order to facilitate dishwasher assembly, it is also known to produce an upwardly open base box made of plastic and having means integrated within the box for mounting the dishwasher components into the box. The tub is placed above the box and is pivotally supported on a shaft. This design, however, still does not solve the lack of stiffness problem mentioned above.

SUMMARY OF THE INVENTION

An object of the invention is to provide a dishwasher which, when completely assembled, has a greater stiffness than has been heretofore known.

A further object of the invention is to provide a dishwasher wherein the tub is easily mounted to the base in a manner which directs any water leaking from the joint, between the tub and the base, back into the tub.

These and other objects and advantages of the invention will be apparent from the following description, drawings, and disclosure.

DESCRIPTION OF THE PREFERRED EMBODIMENT

Figure 1:
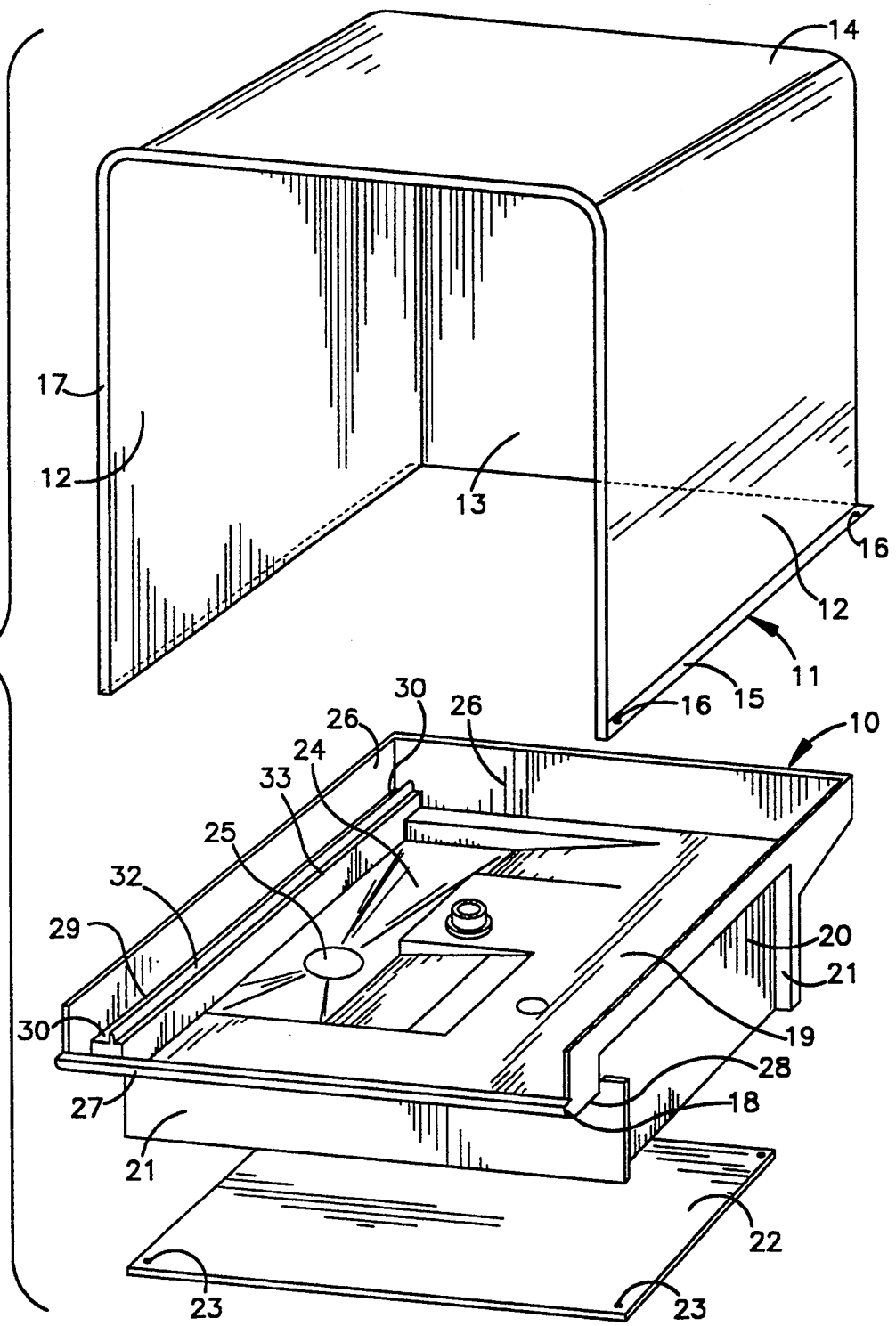
FIG. 1 an exploded, perspective view of a device for a dishwasher in accordance with the invention.

Referring to FIG. 1, the dishwasher comprises a base 10 and an upper part 11, which together enclose a dish basket (not shown) on which dishes are stored, and at least one rotating wash arm (not shown). The upper part 11 has two side walls 12, a rear wall 13, and a roof 14. The lower part of each side wall 12 has a projecting flange 15 with holes 16 for fastening the upper part to the base. The upper part 11 preferably is made from stainless steel or plastic and has an outwardly directed flange 17 surrounding the opening of the tub.

The open side of the tub is provided with a door (not shown) which is supported on dowels 18 arranged at each side of the base 10.

Figure 2:
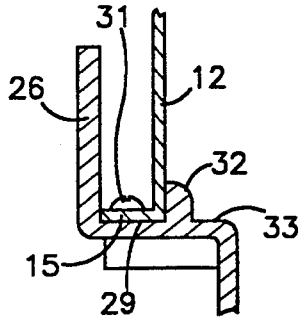
FIG. 2 is an enlarged, fragmentary cross section which shows how the housing is fastened to the base of the dishwasher.

The base 10 is the main element of a stiff shell structure with an upper, generally horizontal, rectangular plate 19 which forms the bottom of the tub. This plate has vertical side walls 20, and front and rear walls 21 joined to the vertical side walls. The plate 19 and the walls 20 and 21 together form a single unit, preferably of plastic, and having the shape of a downwardly opening box. The opening of the box is covered by a lower horizontal plate 22 having holes 23 which, with the aid of screws (not shown), is joined to the base part 10. The resulting union between the plate 22 and the base part 10 provides a very stiff and torsion or twisting force-resistant shell structure in which the required dishwasher components (not shown), such as a circulation pump and a drain pump, are installed. The upper plate 19 slopes towards a hopper 24 which is covered by a sieve (not shown) and continues into a sump 25, in which the water is collected before it leaves via the circulation or drain pump. The plate has at its side edges and at its rear edge a vertical flange 26 which is produced in one piece with the plate 19. At the front of the base 10, the plate 19 has a curved portion 28 which folds back to form a narrow flange 27. At each side edge of the plate 19, there is a seat 29 with fastening holes 30 in which the upper part 11 can be joined to the base 10 by means of screws 31. The seat is provided with a ridge 32, with the distance between the ridge and the flange 26 being such that the flange 15 of the upper part 11 fits therebetween (see FIG. 2). The seat at the interior side of the tub continues into a path 33 on which wheels belonging to the basket are supported.

The upper plate 19 with the surrounding flanges 26 and 27 form a tray in which the upper part 11 is placed so that any water leaking out from between the upper plate and the upper part is directed back into the tub.

By choosing a suitable production technology, it is possible to produce a stiff structure wherein the base part 10 and the plate 22 are formed together as a single unitary structure. It is also possible to provide openings in the shell structure, provided that the sizes and positions of the openings do not have any serious influence on the stiffness of the structure.

While what is presently considered to be the most practical and preferred embodiment of the invention has been described, it is to be understood that the invention is not to be limited to the disclosed embodiment but, to the contrary, is intended to cover various modifications and equivalent arrangements included within the spirit and scope of the appended claims.

What is claimed is:

1. A tub for a dishwasher, said tub having an upper part (11) which is shaped as an open-ended box and a lower part (10) which comprises a torsion stiff shell and a lower part (10) which comprises a torsion stiff shell structure, wherein the upper part is open at a front end and at a bottom end, said bottom end being placed on said torsion stiff shell structure (10, 22), wherein the shell structure itself is a closed box structure, said closed box structure being defined by upper and lower generally horizontal plates (19 and 22, respectively) and generally vertical sidewall elements (20,21), said sidewall elements (20,21) interconnecting the upper and lower plates (19,22) to form said closed box structure, an upper surface of said upper plate (19) closing the open bottom of said upper part, said upper and lower parts being attached to each other to prevent relative movement therebetween and thereby forming said tub.

2. A dishwasher tub according to claim 1, wherein the upper plate (19) and said sidewall elements (20,21) are formed from a single continuous piece of plastic.

3. A dishwasher tub according to claim 2, wherein the lower plate (22) is secured to said sidewall elements (20,21).

4. A dishwasher tub according to claim 30, wherein an edge of said upper plate (19) is provided with a first upwardly directed flange (26).

5. A dishwasher tub according to claim 4, wherein said upper plate (19) is generally rectangular and the first flange (26) extends upwardly at three sides of the upper plate.

6. A dishwasher tub according to claim 5, wherein a second flange (27) is provided at a fourth side of said upper plate, said first flange (26) extending upwardly a greater distance than said second flange (27).

7. A dishwasher tub according to claim 6, wherein said upper part of the tub further comprises vertical walls (12,13) which are fastened to said shell structure adjacent an inner surface of said first flange (26).

8. A dishwasher tub according to claim 7, wherein said upper plate (19) is provided with a recess (25), said upper plate (19) having portions that at least partly slope towards the recess.

9. A dishwasher tub according to claim 2, wherein said upper plate (19) is provided with a recess (25), said upper plate (19) having portions that at least partly slope towards the recess.

10. A dishwasher tub according to claim 1, wherein said upper plate (19) is provided with a recess (25), said upper plate (19) having portions that at least partly slope towards the recess.

11. A tub for a dishwasher, said tub having an upper part (11) which is shaped as an open-ended box and a lower part (10) which comprises a torsion stiff shell structure, wherein the upper part is open at a front end and at a bottom end, said bottom end being placed on said torsion stiff shell structure (10, 22), wherein the shell structure itself is a closed box structure, said closed box structure being defined by upper and lower generally horizontal plates (19 and 22, respectively) and generally vertical sidewall elements (20,21), said sidewall elements (20,21) interconnecting the upper and lower plates (19,22) to form said closed box structure, an upper surface of said upper plate (19) closing the open bottom of said upper part, said upper part being attached to the upper plate of said lower part to prevent relative movement therebetween and thereby forming said tub.

12. A dishwasher tub according to claim 11, wherein said upper part includes an outwardly extending flange, said flange being attached to the upper surface of said upper plate of said lower part.

13. A dishwasher tub according to claim 11, wherein the upper plate (19) and said sidewall elements (20,21) are formed from a single continuous piece of plastic.

14. A dishwasher tub according to claim 13, wherein the lower plate (22) is secured to said sidewall elements (20, 21).

15. A dishwasher tub according to claim 14, wherein an edge of said upper plate (19) is provided with a first upwardly directed flange (26).

16. A dishwasher tub according to claim 15, wherein said upper plate (19) is generally rectangular and the first flange (26) extends upwardly at three sides of the upper plate.

17. A dishwasher tub according to claim 16, wherein a second flange (27) is provided at a fourth side of said upper plate, said first flange (26) extending upwardly a greater distance than said second flange (27).

18. A dishwasher tub according to claim 17, wherein said upper part of the tub further comprises vertical walls (12,13) which are fastened to said shell structure adjacent an inner surface of said first flange (26).

19. A dishwasher tub according to claim 18, wherein said upper plate (19) is provided with a recess (25), said upper plate (19) having portions that at least partly slope towards the recess.

20. A dishwasher tub according to claim 11, wherein said upper plate (19) is provided with a recess (25), said upper plate (19) having portions that at least partly slope towards the recess.

* * * * *